US008783979B2

(12) United States Patent
Hara

(10) Patent No.: US 8,783,979 B2
(45) Date of Patent: Jul. 22, 2014

(54) PRINT MEDIA TRANSFER SCHEDULE SETTING UNIT AND METHOD FOR IMAGE FORMING APPARATUS

(75) Inventor: Masashi Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 328 days.

(21) Appl. No.: 13/191,106

(22) Filed: Jul. 26, 2011

(65) Prior Publication Data

US 2012/0027490 A1 Feb. 2, 2012

(30) Foreign Application Priority Data

Jul. 29, 2010 (JP) ..... P2010-170373

(51) Int. Cl.
*B41J 29/38* (2006.01)
*B65H 3/44* (2006.01)
*B65H 85/00* (2006.01)

(52) U.S. Cl.
USPC ..... 400/76; 400/582; 400/624; 347/104

(58) Field of Classification Search
CPC ..... G03G 15/234; G03G 2215/00586; G03G 2215/00447; G03G 2215/00599; B41J 13/0009; B41J 13/0054
USPC ..... 400/76, 578, 582, 606, 624, 625; 347/104; 399/402
See application file for complete search history.

(56) References Cited

U.S. PATENT DOCUMENTS

| | | | | |
|---|---|---|---|---|
| 6,608,991 | B2 * | 8/2003 | Takada | 399/394 |
| 6,741,819 | B2 * | 5/2004 | Han | 399/82 |
| 2002/0018679 | A1 * | 2/2002 | Miyajima | 399/389 |

FOREIGN PATENT DOCUMENTS

| | | | | | |
|---|---|---|---|---|---|
| JP | 2001282050 | A | * | 10/2001 | G03G 21/00 |
| JP | 2003122071 | A | * | 4/2003 | G03G 15/00 |
| JP | 2005055788 | A | * | 3/2005 | G03G 21/00 |
| JP | 2005-280897 | A | | 10/2005 | |
| JP | 3880281 | B2 | | 11/2006 | |
| JP | 2009151224 | A | * | 7/2009 | G03G 21/00 |

* cited by examiner

*Primary Examiner* — Daniel J Colilla
(74) *Attorney, Agent, or Firm* — Nath Goldberg & Meyer; Jerald L. Meyer

(57) ABSTRACT

There are provided a plurality of paper feed units 20 drawing and feeding, one by one, print media stacked on a paper feed table, a printing unit 30 printing a print medium, a secondary paper feed unit 14 feeding a print medium fed from the plurality of the paper feed units 20 to the printing unit 30, a circulating path CR on which a print medium printed by the printing unit 30 is transferred at a transfer speed of the print medium determined for each sheet size, a reversal unit 50 reversing a print medium transferred on the circulating path CR to feed the reversed print medium to the secondary paper feed unit 14, a transfer schedule setting unit 70*c* setting, when a double-sided printing request of a set of print media of two kinds of sheet sizes is included in a print job, a transfer schedule of the print media of two kinds of sheet sizes so that the waiting time for transfer in the print job is reduced, and an equipment control unit 70*d* causing the plurality of the paper feed units 20 or the reversal unit 50 to feed a sheet to the secondary paper feed unit 14 based on the set transfer schedule.

8 Claims, 8 Drawing Sheets

PRINT MEDIA TRANSFER SCHEDULE SETTING UNIT AND METHOD FOR IMAGE FORMING APPARATUS

BACKGROUND OF THE INVENTION

1. Technical Field

The present invention relates to an image forming apparatus and image forming method capable of double-sided printing.

2. Related Arts

There is an image forming apparatus that has a circulating transfer route including a sheet reversal path. This apparatus performs, when a one-sided printing is selected, the one-sided printing by printing on one side of a print medium and then discharging the printed print medium without using the sheet reversal path and at the same time, and performs, when a double-sided printing is selected, the double-sided printing by printing on one side of a print medium and at the same time, printing on the other side by transferring the print medium on the one side of which printing is performed through the circulating transfer route to reverse the print medium.

In such an image forming apparatus capable of a double-sided printing, when the double-sided printing is performed on print media of two or more kinds of sheet sizes, the transfer speed at which the sheet is transferred through the circulating transfer route differs depending on the sheet size, and therefore, it is necessary to perform printing for each sheet size. Because of this, the waiting time for transfer of the print medium is long and a considerable time is required to complete printing.

Japanese Patent No. 3880281 proposes an image forming apparatus comprising a first detector detecting a state of waiting for a print medium being transferred along a circulating path to be fed again, a second detector detecting a state of waiting for a sheet for double-sided image formation and a sheet for one-sided image formation to be fed by a feeding unit, a determining unit determining whether or not there is a sheet for double-sided image formation in a range from the foremost sheet waiting to be fed to the last sheet waiting to be fed of the sheets, the number of which is twice the number of sheets for double-sided image formation waiting to be fed again, based on the detection results of the first detector and the second detector, and a control unit controlling so as to feed, when there is a sheet for double-sided image formation in the range of the sheets waiting to be fed, the foremost sheet waiting to be fed by regarding it as a sheet for double-sided image formation and to feed a sheet again along the circulating path.

SUMMARY OF THE INVENTION

However, according to the above technique, it is necessary to newly provide the detectors, that is, the first detector and the second detector and it is also necessary to provide a new configuration to put a print medium on standby, and therefore, there used to be such a problem that the configuration of the apparatus becomes complicated.

The present invention has been made in view of the above problem and an object thereof is to provide an image forming apparatus and image forming method capable of reducing the time required to complete printing with a simple configuration when performing a double-sided printing on print media of two or more kinds of sheet sizes.

In order to achieve the above-mentioned object, an image forming apparatus according to an embodiment of the present invention comprises a plurality of paper feed units drawing and feeding, one by one, print media stacked on a paper feed table with sheet sizes different from one another; a printing unit printing a print medium fed by the paper feed unit based on a received print job; a resist unit transferring a print medium fed from the plurality of paper feed units to the printing unit at a predetermined timing; a circulating path on which a print medium printed by the printing unit is transferred at a transfer speed determined for each sheet size; a reversal unit reversing a print medium transferred on the circulating path to transfer the reversed print medium to the resist unit; a transfer schedule setting unit alternatively setting, when a double-sided printing request of a set of print media of a plurality of kinds of sheet sizes is included in the print job, a transfer schedule of the print media of the plurality of kinds of sheet sizes so that a printing processing time is reduced when a large number of print media of a relatively small sheet size are included in the one set of print media and when a large number of print media of a relatively large sheet size are included in the one set of print media, respectively; and a control unit starting feeding or transfer from any one of the plurality of paper feed units or the reversal unit to the resist unit based on the set transfer schedule.

Similarly, in order to achieve the above-mentioned object, an image forming method according to an embodiment of the present invention is an image forming method of an image forming apparatus including a plurality of paper feed units drawing and feeding, one by one, print media stacked on a paper feed table with sheet sizes different from one another, a printing unit printing a print medium fed by the paper feed unit based on a received print job, a resist unit transferring a print medium fed from the plurality of paper feed units to the printing unit at a predetermined timing; a circulating path on which a print medium printed by the printing unit is transferred at a transfer speed determined for each sheet size, a reversal unit reversing a print medium transferred on the circulating path to transfer the reversed print medium to the resist unit, the method comprising: alternatively setting, when a double-sided printing request of a set of print media of a plurality of kinds of sheet sizes is included in the print job, a transfer schedule of the print media of the plurality of kinds of sheet sizes so that a printing processing time is reduced when a large number of print media of a relatively small sheet size are included in the one set of print media and when a large number of print media of a relatively large sheet size are included in the one set of print media, respectively; and starting feeding or transfer from any one of the plurality of paper feed units or the reversal unit to the resist unit based on the set transfer schedule.

BRIEF DESCRIPTION OF THE DRAWINGS

FIG. 5 is a diagram for schematically explaining a transfer schedule in the image forming apparatus in FIG. 1.

5C is a diagram showing a transfer schedule when printing the first sheet and the second sheet by prior art.

DETAILED DESCRIPTION OF THE EMBODIMENTS

An embodiment of the present invention is explained with reference to the drawings.

Here, a line-type image forming apparatus is explained as an example, which comprises a plurality of ink jet heads in which a number of nozzles are formed and performs printing on a print medium in units of lines by ejecting black or color ink from the respective ink jet heads.

<General Configuration of Image Forming Apparatus>

Figure 1:
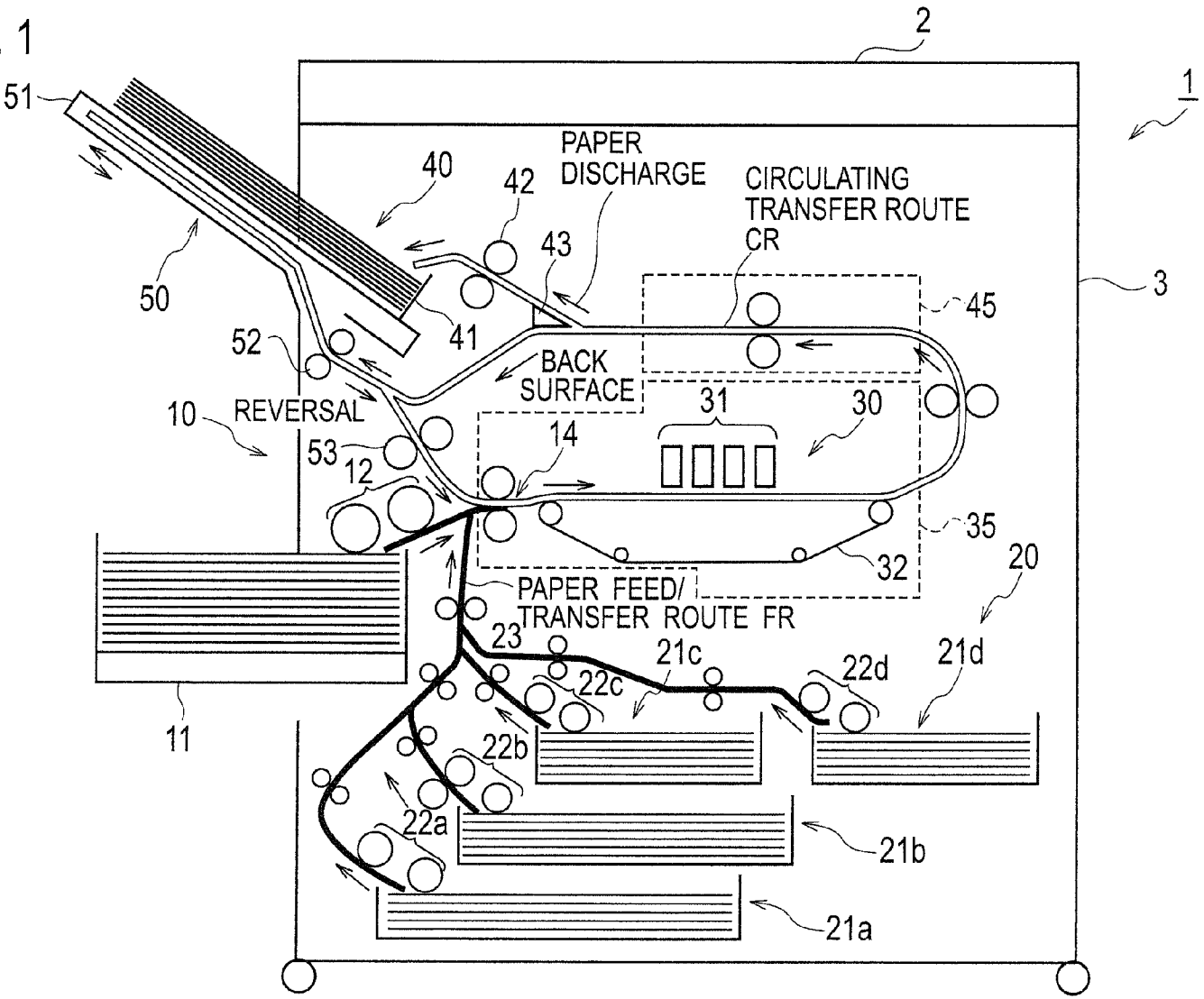
FIG. 1 is a general configuration diagram showing a general configuration of an image forming apparatus, an embodiment of the present invention.

FIG. 1 is a general configuration diagram showing a general configuration of an image forming apparatus, an embodiment of the present invention.

As shown in FIG. 1, an image forming apparatus 1 comprises an image reading unit 2 and an image forming unit 3.

The image reading unit 2 is provided at the top part of the image forming unit 3 and includes, although not shown schematically, contact glass on which a document is placed, a cover provided in an attachable/detachable manner to the contact glass, a scan unit that scans a document placed on the contact glass, a lens that converges a scanned image, and an image processing unit that processes a converged image.

Then, the image reading unit 2 reads image data to be printed by the image forming unit 3 when the scan unit scans a document placed on the contact glass for each line and the image processing unit processes the scanned image.

The image forming unit 3 includes a side paper feed unit 10, an internal paper feed unit 20, a printing unit 30, a paper discharge unit 40, and a reversal unit 50.

The side paper feed unit 10 includes a paper feed table 11 on which print media are stacked, a primary paper feed unit 12 that transfers only the print medium in the uppermost position from the paper feed unit 11 onto a paper feed/transfer route FR when the paper feed table 11 is at a feeding position (a position in the vertical direction of the paper feed table 11 in which a print medium can be fed from the paper feed table 11) and a secondary paper feed unit 14 that transfers the print medium transferred by the primary paper feed unit 12 to the printing unit 30. The print medium transferred on the paper feed/transfer route FR by the primary paper feed unit 12 is caused to hit against the second paper feed unit 14, and thereby, alignment of the front end of the print medium and skew correction are performed, and then, at a predetermined timing, it is transferred on a circulation/transfer route CR toward the printing unit 30.

The internal paper feed unit 20 includes paper feed tables 21*a*, 21*b*, 21*c* and 21*d* on which print sheets W are stacked and primary paper feed units 22*a*, 22*b*, 22*c* and 22*d*, that transfer only the print sheet W in the uppermost position onto a paper feed/transfer route SR from these paper feed tables 21*a*, 21*b*, 21*c* and 21*d*.

The print media transferred onto the paper feed system/transfer route FR by the primary paper feed units 22*a*, 22*b*, 22*c* and 22*d*, respectively, are transferred on the paper feed/transfer route FR by a plurality of transfer rollers, such as a transfer roller 23 installed on the paper feed/transfer route FR and then, caused to hit against the secondary paper feed unit 14, and thereby, alignment of the front end of the print media and skew correction are performed and then, at a predetermined timing, they are transferred on the circulating transfer route CR toward the printing unit 30.

The printing unit 30 includes a head unit 31 in which a plurality of print heads is incorporated and an annular transfer belt 32 provided on the surface opposite to the head unit 31 and the print medium fed by the secondary paper feed unit 14 is adsorbed onto the transfer belt 32 by a sucking unit, not shown schematically, installed within the annular transfer belt 32 and while the print medium is being transferred at a speed determined by printing conditions, printing is performed on the print medium in units of lines by ink ejected from the head unit 31 and then the print medium is discharged.

The print medium printed by the printing unit 30 and discharged is transferred on the circulation/transfer route CR by the transfer roller etc. arranged on the circulation/transfer route CR. On the circulation/transfer route CR, a switching mechanism 43 is provided, which switches between guiding the print medium transferred on the circulation/transfer route CR to the paper discharge unit 40 and re-circulating the print medium on the circulation/transfer route CR (guiding to the reversal unit 50).

The paper discharge unit 40 has a paper discharge table 41 in the shape of a tray protruding from the housing of the image forming apparatus 1 and a pair of paper discharge rollers 42 that guide print media to the paper discharge table 41. Then, the print media printed by the printing unit 30 are transferred to the paper discharge table 41 by the paper discharge roller 42 and stacked on the paper discharge table 42 with the printed surface facing downward.

The reversal unit 50 includes a reversal table 51 that reverses a print medium and a reversal roller 52 that transfers the print medium from the circulation/transfer route CR to the reversal table 51 or from the reversal table 51 onto the circulation/transfer route CR.

The print medium guided to the reversal unit 50 by the switching mechanism 43 is transferred from the circulation/transfer route CR to the reversal table 51 by the reversal roller 52 and after a predetermined time elapses, it is transferred from the reversal table 51 to the circulation/transfer route CR, and thereby, the surface and back surface are reversed with respect to the circulation/transfer route CR. Then, the reversed print medium is transferred on the circulation/transfer route CR by a plurality of rollers, such as transfer rollers 53 provided on the circulation/transfer route CR and caused to hit against the secondary paper feed unit 14. Due to this, the print medium is loosened and thereby, alignment of the front end of the print medium and skew correction are performed and then, the print medium is transferred on the circulation/transfer route CR toward the printing unit 30 at a predetermined timing.

Here, the transfer speed of a print medium when transferred in a printing area 35 of the circulation/transfer route CR is a printing speed Vp optimum to the ejection of ink by the head unit 31 and in the present specification, although explanation is given on the assumption that the speed is fixed regardless of the sheet size of the print medium, it may also be possible to appropriately adjust the speed according to the sheet size.

On the other hand, the number of print media held on the circulation/transfer route CR differs depending on the sheet size, and therefore, the transfer speed of the print medium when transferred on a circulating area 45 of the circulation/transfer route CR differs depending on the sheet size of the print medium.

<Functional Configuration of Image Forming Apparatus>

Figure 2:
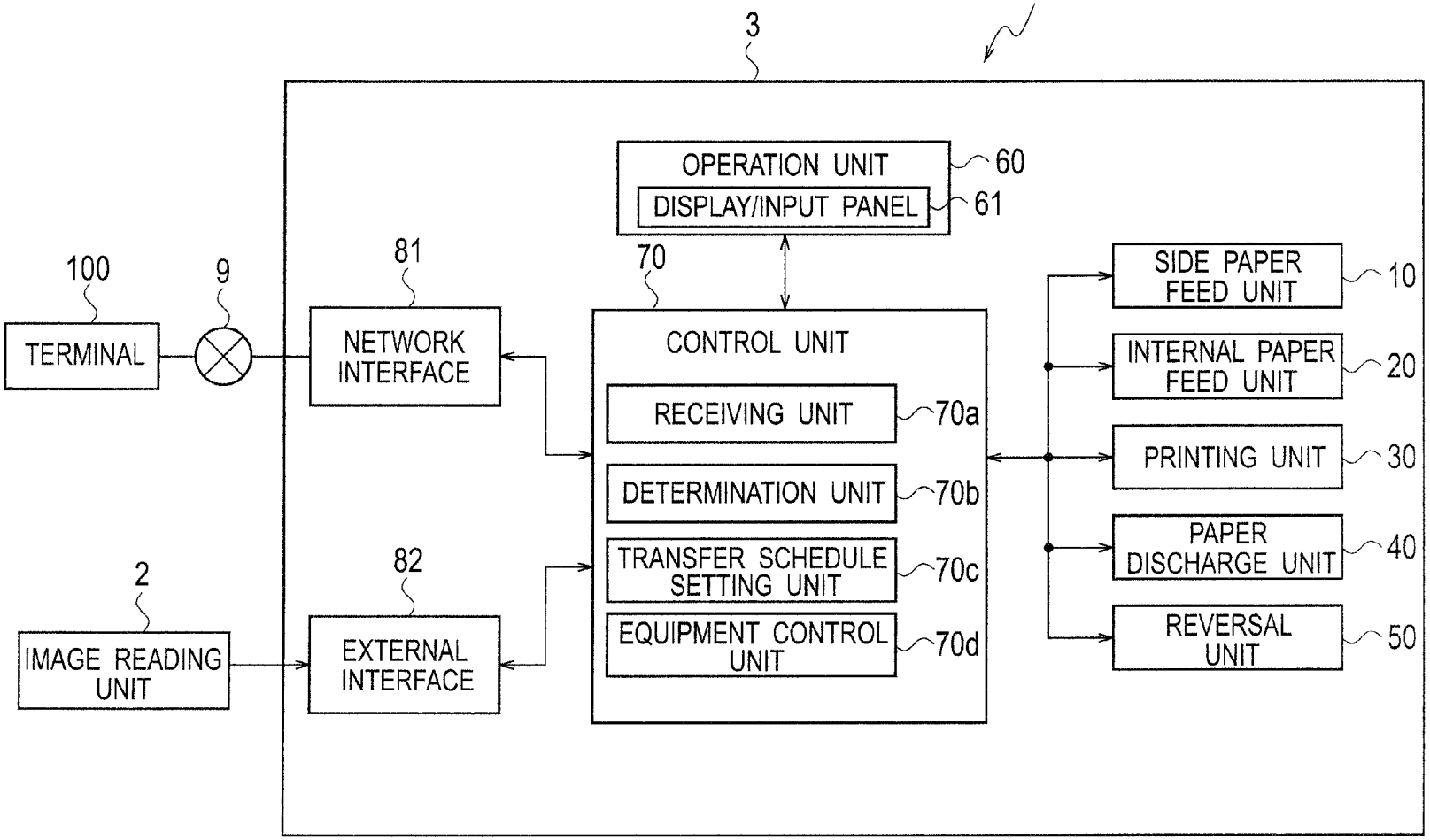
FIG. 2 is a functional configuration diagram showing a functional configuration of the image forming apparatus in FIG. 1.

FIG. 2 is a functional configuration diagram showing a functional configuration of the image forming apparatus 1.

As shown in FIG. 2, the image forming apparatus 1 is connected to a terminal 100 via a network 9.

The terminal 100 generates image data by executing software and transmits a print job including generated image data and printing setting information, which is information about various settings of printing, such as the minimum paper feed interval, number of sheets within path, transfer speed, sheet size, and number of copies to be printed, to the image forming apparatus 1 via the network 9.

The image forming apparatus 1 comprises the image reading unit 2 and the image forming unit 3.

The image forming unit 3 includes the side paper feed unit 10, the internal paper feed unit 20, the printing unit 30, the paper discharge unit 40, the reversal unit 50, an operation unit 60, a control unit 70, a network interface 81, and an external interface 82. Of theses configurations, the side paper feed unit 10, the internal paper feed unit 20, the printing unit 30, the paper discharge unit 40, and the reversal unit 50 are described above, and therefore, their explanation is omitted.

The operation unit 60 is provided at the top part of the image forming apparatus 1 and includes a display/input panel 61 and various operation keys, such as a start key to start reading, printing, etc., a stop key to stop reading, printing, etc., and a ten key to enter the number of sheets to be printed (neither is shown schematically), and supplies an operation signal based on a user's operation to the control unit 70.

The display/input panel 61 of the operation unit 60 has a pressure-sensitive or electrostatic transparent touch panel arranged on the front surface and a liquid crystal display panel arranged on the back surface of the touch panel (neither is shown schematically). It is possible for a user to perform various setting input operations etc., such as setting of the number of copies to be print, by directly touching the surface of the touch panel with a finger etc. while watching the display screen of the liquid crystal display panel.

The network interface 81 is a communication interface, such as a network card, and receives image data from the terminal 100 connected to the network 9 and transmits/receives various signals by connecting the image forming apparatus 1 to the network 9 via the network interface 8.

The external interface 82 is a connection interface to the image reading unit 2 and supplies image data read by the image reading unit 2 to the control unit 70.

The control unit 70 performs essential control of the image forming apparatus 1. The control unit 70 includes a receiving unit 70*a*, a determination unit 70*b*, a transfer schedule setting unit 70*c*, and an equipment control unit 70*d* to implement its functions.

The receiving unit 70*a* receives a print job transmitted from the terminal 100 via the network interface 81. The receiving unit 70*a* further receives a print job transmitted from the image reading unit 2 via the external interface 82.

The determination unit 70*a* determines whether or not a double-sided printing request using print media of two kinds of sheet sizes is included in the print job received by the receiving unit 70*a*.

The transfer schedule setting unit 70*c* sets a transfer schedule of the print media of two kinds of sheet sizes so that the waiting time for transfer is reduced when a double-sided printing request using print media of two kinds of sheet sizes is included in the print job.

Specifically, the transfer schedule setting unit 70*c* sets one of the following two transfer schedules, those being a first transfer schedule or a second transfer schedule. The first transfer schedule transfers the print media having two kinds of different sheet sizes to the secondary paper feed unit 14. The first transfer schedule operates by transferring the print media having the two different sheet sizes on the circulation/transfer route CR at a particular transfer speed. This particular transfer speed is a transfer speed corresponding to a larger sheet size. The second transfer schedule transfers the print medium of a second sheet size, which follows the print medium of a first sheet size being different from the second sheet size, to the secondary paper feed unit 14 coming from the side paper feed unit 10 or the internal paper feed unit 20, but before transferring the last print medium of the first sheet size that is reversed by the reversal unit 50 to the secondary paper feed unit 14 and then onward to the printing unit 30. The second transfer schedule operates the above transfer for each set of the print media of the first and second sheet sizes. The above transfer speed corresponding to a larger sheet size is a transfer speed at which a print medium of the larger sheet size is transferred on the circulation/transfer route CR in a normal print job processing explained below.

The equipment control unit 70*d* prints based on the image data included in the print job received by the receiving unit 70*a*. Specifically, the equipment control unit 70*d* performs printing on one side or both sides of the transferred print medium by controlling the printing unit 30, the paper discharge unit 40, and the reversal unit 50.

<Working of Image Forming Apparatus>

Next, working of the image forming apparatus 1 is explained.

<<Printing Main Processing>>

Details of printing main processing in the image forming apparatus 1 are explained.

Figure 3:
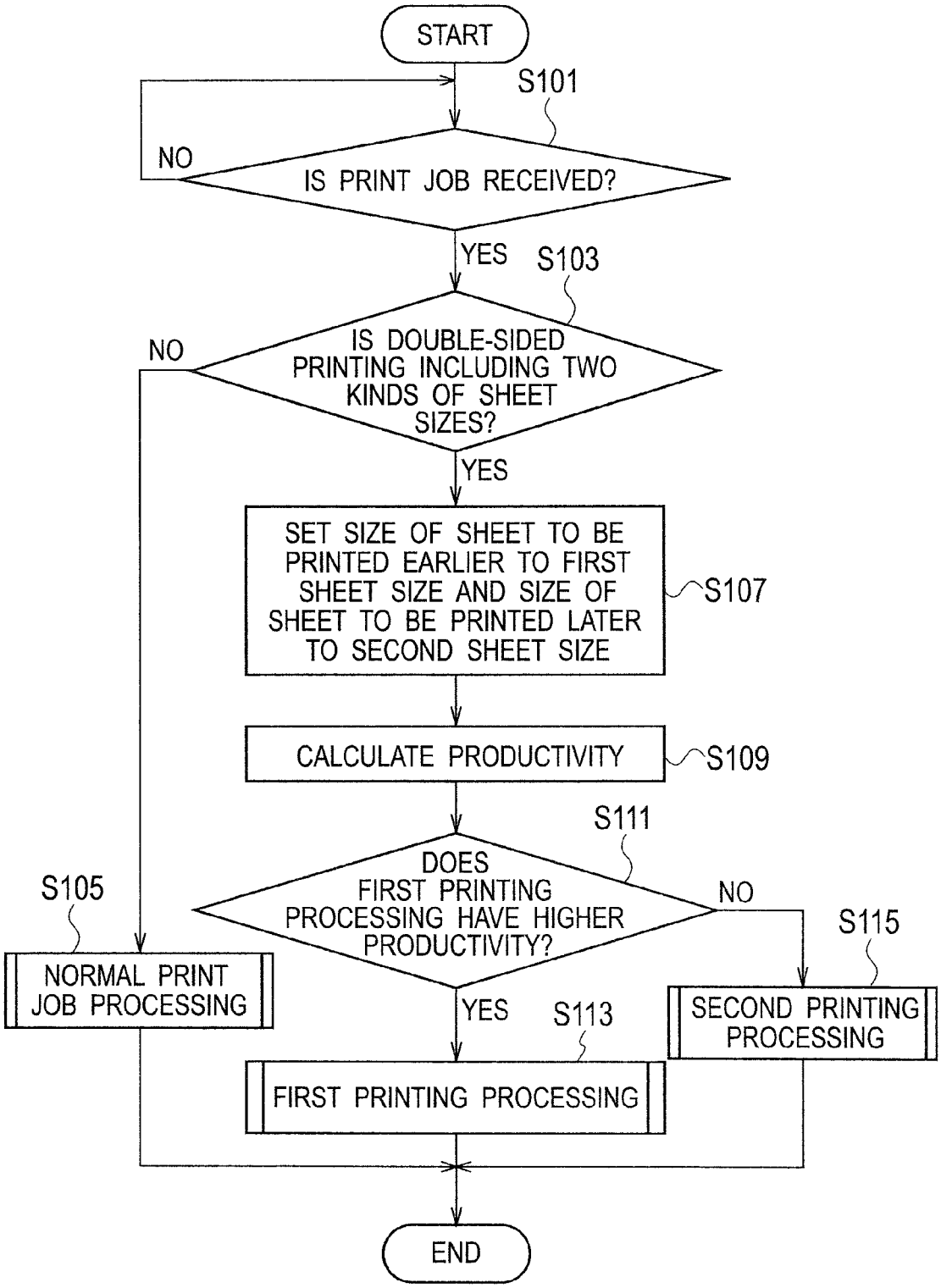
FIG. 3 is a flowchart showing printing main processing in the image forming apparatus in FIG. 1.

FIG. 3 is a flowchart showing printing main processing in the image forming apparatus 1.

As shown in FIG. 3, the receiving unit 70*a* of the control unit 70 determines whether or not a print job is received (step S101).

When it is determined that a print job is received in step S101 (when YES), the determination unit 70*b* of the control unit 70 determines whether or not a double-sided printing request using print media of two kinds of sheet sizes is included in the received print job (step S103). Sheet sizes are sizes of print media used for printing, such as A4, A3, B5 and B4, and the determination unit 70*b* determines whether or not a double-sided printing request signal using print medium of any two kinds of sheet sizes of these sheet sizes is included.

When it is determined that a double-sided printing request using print media of two kinds of sheet sizes is not included in the print job in step S103 (when NO), the equipment control unit 70*d* of the control unit 70 performs normal print job processing (step S105). Specifically, the equipment control unit 70*d* performs printing by controlling the side paper feed unit 10, the internal paper feed unit 20, the printing unit 30, the paper discharge unit 40, and the reversal unit 50 and discharges the printed print media.

On the other hand, when it is determined that a double-sided printing request using print media of two kinds of sheet sizes is included in the print job in step S103 (when YES), the transfer schedule setting unit 70*c* sets the sheet size of the print medium to be printed earlier to a first sheet size and the sheet size of the print medium to be printed later to a second sheet size which is different from the sheet size (step S107).

Next, the transfer schedule setting unit 70*c* calculates productivity of the first transfer schedule and the second transfer schedule based on the print job (step S107). Here, the first transfer schedule refers to a transfer schedule to feed print media of two different sheet sizes (the first sheet size and the second sheet size) to the secondary paper feed unit 14 by transferring the print media of the two different sheet sizes on the circulation/transfer route CR at a particular transfer speed. The particular transfer speed is a transfer speed corresponding to the larger sheet size. The second transfer schedule refers to a transfer schedule to transfer the print medium of the second sheet size, which follows the print medium of the first sheet size, to the secondary paper feed unit 14, coming from the side paper feed unit 10 or the internal paper feed unit 20, but before transferring the last print medium of the first sheet size that is reversed by the reversal unit 50 to the secondary paper feed unit 14 and then onward to the printing unit 30. The second transfer schedule operates the above transfer for each set of the print media of the two different sheet sizes (the first sheet size and the second sheet size).

Specifically, the transfer schedule setting unit 70*c* calculates productivity $P_1$ of the first transfer schedule using $$P_1=TI_2\times(S_1+S_2)\times 2 \quad \text{(Equation 1)}$$

where print time $TI_2$ is a print time (sec) of the print medium of the second sheet size and calculated using $$TI_2=L_2/Vp+TM_2 \quad \text{(Equation 2)}$$

Here $L_2$ is a length (mm) in the transfer direction of the print medium of the second sheet size, Vp is a print speed (mm/s), and $TM_2$ is the minimum paper feed interval (sec) of the print medium of the second sheet size. A number of sheets to be fed $S_1$ is the number of print media of the first sheet size in one set and a number of sheets to be fed $S_2$ is the number of print media of the second sheet size in one set. It is assumed here that the second sheet size is larger than the first sheet size.

Further, the transfer schedule setting unit 70*c* calculates productivity $P_2$ of the second transfer schedule using $$P_2=TI_1\times[(C_1-1)+(S_1-1)]\times 2+TI_2\times[(C_2-1)+(S_2-1)]\times 2 \quad \text{(Equation 3)}$$

where print time $TI_1$ is a print time (sec) of the print medium of the first sheet size and calculated using $$TI_1=L_1/Vp+TM_1 \quad \text{(Equation 4)}$$

Here $L_1$ is a length (mm) in the direction of the transfer of the print medium of the first sheet size, Vp is a print speed (minis), and $TM_1$ is the minimum paper feed interval (sec) of the print medium of the first sheet size. A number of sheets within path $C_1$ is the number of print media of the first sheet size held within the circulation/transfer route CR and, for example, when the sheet size is A4, the number is "4". The number of sheets to be fed $S_1$ is the number of print media of the first sheet size in one set. The print time $TI_2$ is a print time (sec) of print media of the second sheet size and calculated using (Expression 2). A number of sheets within path $C_2$ is the number of the print media of the second sheet size held within the circulation/transfer route CR and, for example, when the sheet size is A3, the number is "2". The number of sheets to be fed $S_2$ is the number of the print media of the second sheet size in one set.

An example of the production efficiency in the case of the productivity $P_1$ of the first transfer schedule and the productivity $P_2$ of the second transfer schedule calculated by the transfer schedule setting unit 70*c* is shown in Table 1. Table 1 shows production efficiency $K_0$ of the transfer schedule according to prior art with productivity $P_0$, production efficiency $K_1$ of the first transfer schedule with the productivity $P_1$, and production efficiency $K_2$ of the second transfer schedule with the productivity $P_2$ when it is assumed that the production efficiency of a transfer schedule in an ideal system with productivity $P_R$ is 100(%).

TABLE 1

[%]

| Sheets to be fed | Production efficiency: Prior art ($K_0$) | First transfer schedule ($K_1$) | Second transfer schedule ($K_2$) |
|---|---|---|---|
| 1 A4 sheet + 1 A3 sheet | 41.3 | 70.3 | 86.6 |
| 2 A4 sheets + 1 A3 sheet | 50.0 | 77.1 | 82.1 |
| 3 A4 sheets + 1 A3 sheet | 56.5 | 81.4 | 79.8 |
| 4 A4 sheets + 1 A3 sheet | 61.4 | 84.3 | 78.5 |
| 5 A4 sheets + 1 A3 sheet | 65.4 | 86.4 | 77.6 |
| 1 A4 sheet + 2 A3 sheets | 52.6 | 78.9 | 91.0 |
| 1 A4 sheet + 3 A3 sheets | 60.2 | 83.6 | 93.3 |
| 1 A4 sheet + 4 A3 sheets | 65.8 | 86.6 | 94.6 |
| 1 A4 sheet + 5 A3 sheets | 69.9 | 88.7 | 95.5 |

Here, the transfer schedule in the ideal system is a schedule when it is assumed that transfer is continued with the minimum paper interval even when the sheet sizes are switched and its productivity $P_R$ is calculated by $$P_R=(TI_1\times S_1\times 2)+(TI_2\times S_2\times 2) \quad \text{(Equation 5)}$$

The transfer schedule of prior art is a schedule to feed the surface of the print medium of the next sheet size after feeding the back surface of the sheet of the same size when the sheet size changes and the productivity $P_0$ is calculated by $$P_0=TI_1\times(C_1+S_1-1)\times 2+TI_2\times(C_2+S_2-1)\times 2 \quad \text{(Equation 6)}$$

As shown in Table 1, compared to the production efficiency $K_0$ of the transfer schedule according to prior art, both the production efficiency $K_1$ of the first transfer schedule and the production efficiency $K_2$ of the second transfer schedule are higher. That is, the number of sheets subjected to printing processing per unit time increases.

When the number of the print media of the smaller sheet size is larger, compared to the production efficiency $K_2$ of the second transfer schedule, the production efficiency $K_1$ of the first transfer schedule is higher and in other cases, the production efficiency $K_2$ of the second transfer schedule is higher.

Next, the transfer schedule setting unit 70*c* determines which is higher of the calculated production efficiency $K_1$ of the first transfer schedule and the calculated production efficiency $K_2$ of the second transfer schedule (step S111).

When it is determined that the production efficiency of the first transfer schedule is higher in step S111 (when YES), the first printing processing is performed (step S113).

On the other hand, when it is determined that the production efficiency of the second transfer schedule is higher in step S111 (when YES), the second printing processing is performed (step S115).

The processing procedure of the first printing processing and the second printing processing is explained below.

<<First Printing Processing>>

Details of the first printing processing in the image forming apparatus 1 are explained.

Figure 4A:
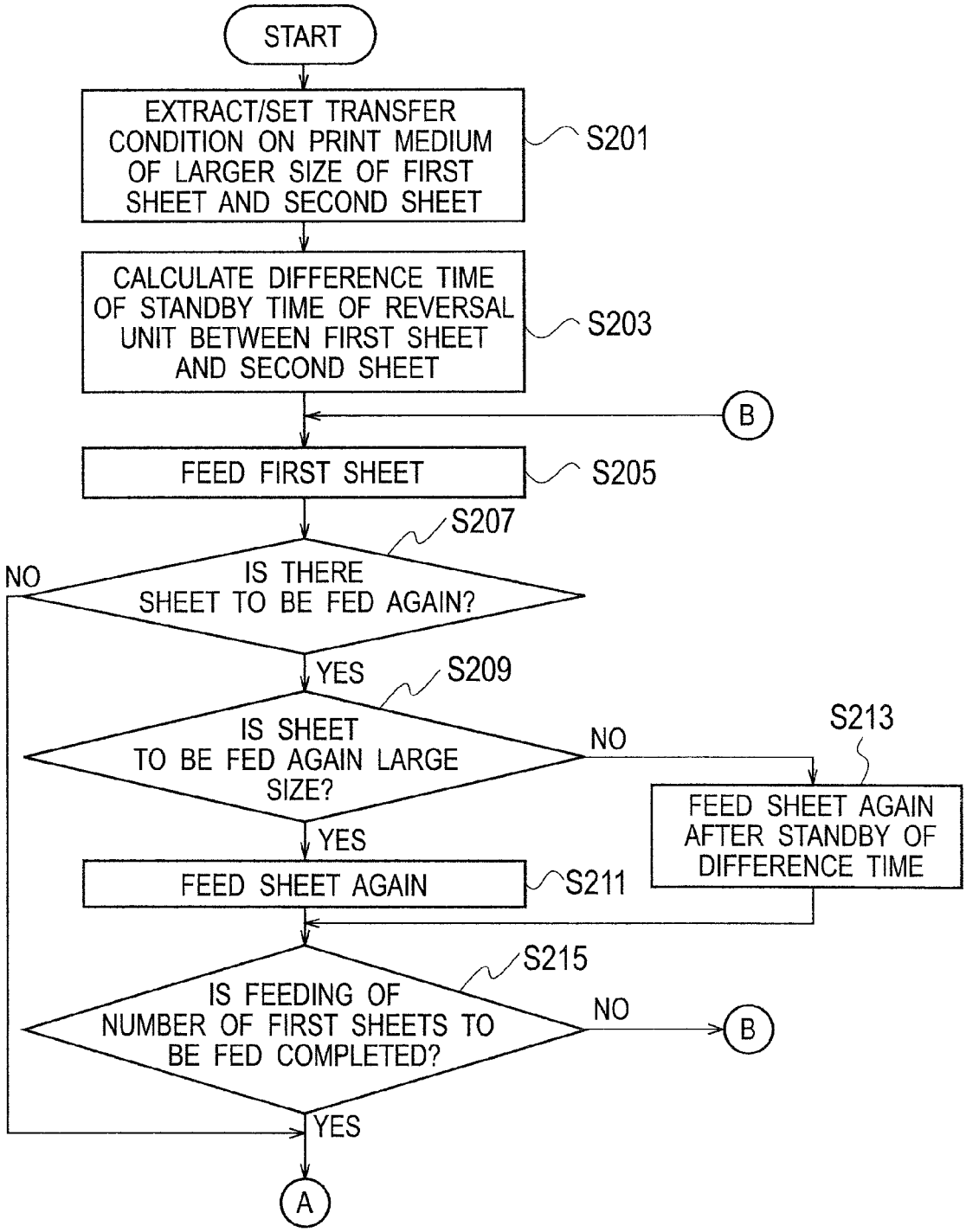
FIGS. 4A and 4B are a flowchart showing first printing processing in the image forming apparatus in FIG. 1.
Figure 4B:
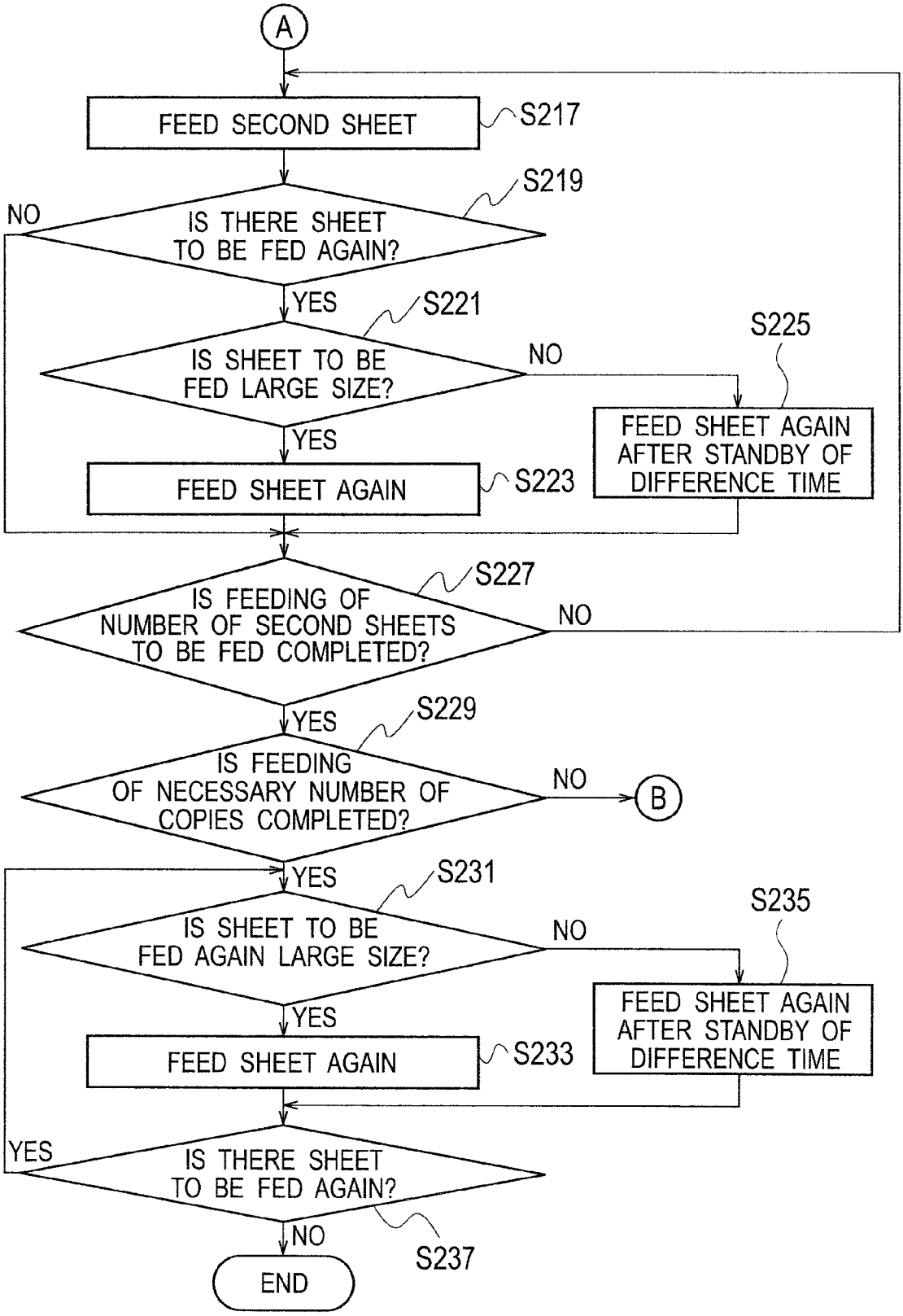

FIGS. 4A and 4B are a flowchart showing the first printing processing in the image forming apparatus 1. The first printing processing is explained using a case as an example, where the print media of A4 size as the first sheet size are stacked on the paper feed table 21*a*, the print media of A3 size as the second sheet size are stacked on the paper feed table 21*b*, and two copies of a set of two A4 sheets and one A3 sheet are printed.

As shown in FIGS. 4A and 4B, the transfer schedule setting unit 70*c* of the control unit 70 extracts and sets the transfer condition corresponding to the print medium of the larger sheet size of the first sheet size and the second sheet size (step S201). Here, the first sheet size is set to "A4" and the second sheet size to "A3", and therefore, the transfer schedule setting unit 70*c* extracts and sets the transfer condition corresponding to the print medium of the second sheet size, which is the larger sheet size. Specifically, the transfer schedule setting unit 70*c* sets the minimum paper feed interval $TM_2$ for the print medium of the second sheet size, the number of sheets within path $C_2$, and the transfer speed $V_2$ on the circulating area 45 of the circulation route CR as the transfer condition from the information about printing settings included in the received print job. Due to this, both the print medium of the first sheet size (hereinafter, the first sheet) and the print medium of the second sheet size (hereinafter, the second sheet) are transferred by the transfer schedule corresponding to the second sheet size.

Next, the transfer schedule setting unit 70*c* calculates difference time R of the standby time on the reversal unit 50 of the first sheet and the second sheet based on the extracted transfer condition (step S203).

The difference time R is calculated in order to adjust the timing at which the first sheet and the second sheet are fed.

Specifically, because the transfer condition corresponding to the larger sheet size (the second sheet size) is set in step S201, the first sheet is also transferred on the circulating area 45 of the circulation/transfer route CR at the transfer speed $V_2$ of the second sheet, and therefore, when the first sheet is fed from the reversal unit 50 to the printing unit 30, there occurs trouble relating timing. That is, the length in the direction of the transfer of the first sheet is shorter compared to the length in the direction of the transfer of the second sheet, and therefore, in order to feed the first sheet in such a manner that the length of the sheet transferred to the reversal table 51 by the reversal roller 52 of the reversal unit 50 is short and the timing is the same as that at which the second sheet is fed, it is necessary to feed the first sheet to the secondary paper feed unit 14 by the reversal roller 52 after temporarily putting the first sheet on standby on the reversal table 51. The time during which the first sheet is put temporarily on standby on the reversal table 51 is referred to as a difference time R.

Next, the equipment control unit 70*d* of the control unit 70 feeds the first sheet (step S205). Specifically, the equipment control unit 70*d* causes the primary paper feed unit 22*a* to transfer only the print medium in the uppermost position from the paper feed table 21*a* onto the paper feed/transfer route FR and at the same time, causes the secondary paper feed unit 14 to transfer the print medium transferred by the primary paper feed unit 22*a* to the printing unit 30 based on the transfer schedule for the second sheet.

Then the transfer schedule setting unit 70*c* of the control unit 70 determines whether or not there is a sheet to be fed again (step S207). Specifically, the transfer schedule setting unit 70*c* determines whether or not there is a print medium on the reversal table 51 of the reversal unit 50.

When it is determined that there is a sheet to be fed again in step S207 (when YES), the transfer schedule setting unit 70*c* determines whether or not the sheet to be fed again is the large sheet size (step S209). Here, whether or not the print medium put on standby on the reversal table 51 of the reversal unit 50 is the second sheet is determined.

When it is determined that the sheet to be fed again is the large sheet size in step S209 (when YES), the equipment control unit 70*d* of the control unit 70 feeds the print medium on the reversal table 51 of the reversal unit 50 again to the printing unit 30 based on the transfer schedule for the second sheet (step S211).

On the other hand, when it is determined that the sheet to be fed again is not the large sheet size in step S209 (when NO), the print medium of the small sheet size, that is, the first sheet is fed again to the printing unit 30 after putting it on standby for the difference time R calculated in step S203 on the reversal table 51 of the reversal unit 50 (step S213).

Next, the transfer schedule setting unit 70*c* of the control unit 70 determines whether or not feeding of the number of the first sheets to be fed 51 is completed (step S215).

When it is determined that feeding of the number of the first sheets to be fed S1 is completed in step S215 (when YES), the equipment control unit 70*d* of the control unit 70 feeds the second sheet (step S217). Specifically, the equipment control unit 70*d* causes the primary paper feed unit 22*b* to transfer only the print medium in the uppermost position from the paper feed table 1*b* onto the paper feed/transfer route FR and at the same time, causes the secondary paper feed unit 14 to transfer the print medium transferred by the primary paper feed unit 22*b* to the printing unit 30.

Then, the transfer schedule setting unit 70*c* of the control unit 70 determines whether or not there is a sheet to be fed again (step S219). Specifically, the transfer schedule setting unit 70*c* determines whether or not there is a print medium on the reversal table 51 of the reversal unit 50.

When it is determined that there is a sheet to be fed again in step S219 (when YES), the transfer schedule setting unit 70*c* determines whether or not the sheet to be fed again is the large sheet size (step S221). Here, the transfer schedule setting unit 70*c* determines whether or not the print medium put on standby on the reversal table 51 of the reversal unit 50 is the second sheet.

When it is determined that the sheet to be fed again is the large sheet size in step S221 (when YES), the equipment control unit 70*d* of the control unit 70 feeds the print medium on the reversal table 51 of the reversal unit 50 again to the printing unit 30 based on the transfer schedule corresponding to the second sheet (step S223).

On the other hand, when it is determined that the sheet to be fed again is not the large sheet size in step S221 (when NO), the equipment control unit 70*d* feeds the first sheet again to the printing unit 30 after putting the first sheet on standby on the reversal table 51 of the reversal unit 50 for the difference time R calculated in step S203 (step S225).

Next, the transfer schedule setting unit 70*c* of the control unit 70 determines whether or not feeding of the number of the second sheets to be fed S2 is completed (step S227).

Then, the transfer schedule setting unit 70*c* determines whether or not feeding of the necessary number of copies is completed (step S229). Here, the transfer schedule setting unit 70*c* determines whether or not the print media corresponding to two copies of a set of the two first sheets (A4 size) and the one second sheet (A3 size) are fed from the paper feed table 21*a* or the paper feed table 21*b*.

Next, the transfer schedule setting unit 70*c* determines whether or not the sheet to be fed again is the large sheet size (step S231). Specifically, the transfer schedule setting unit 70*c* determines whether or not the print medium put on standby on the reversal table 51 of the reversal unit 50 is the second sheet.

When it is determined that the sheet to be fed again is the large sheet size in step S231 (when YES), the equipment control unit 70*d* of the control unit 70 feeds the print medium on the reversal table 51 of the reversal unit 50 again to the printing unit 30 based on the transfer schedule for the second sheet (step S233).

On the other hand, when it is determined that the sheet to be fed again is not the large size sheet in step S231 (when NO), the equipment control unit feeds the first sheet again to the printing unit 30 after putting the first sheet on standby on the reversal table 51 of the reversal table for the difference time R calculated in step S203.

Then the transfer schedule setting unit 70*c* determines whether or not there is a sheet to be fed again (step S237) and when determining that there is a sheet to be fed again (when YES), exits the processing.

Figures 5A, 5B, 5C, 5D, 5E:
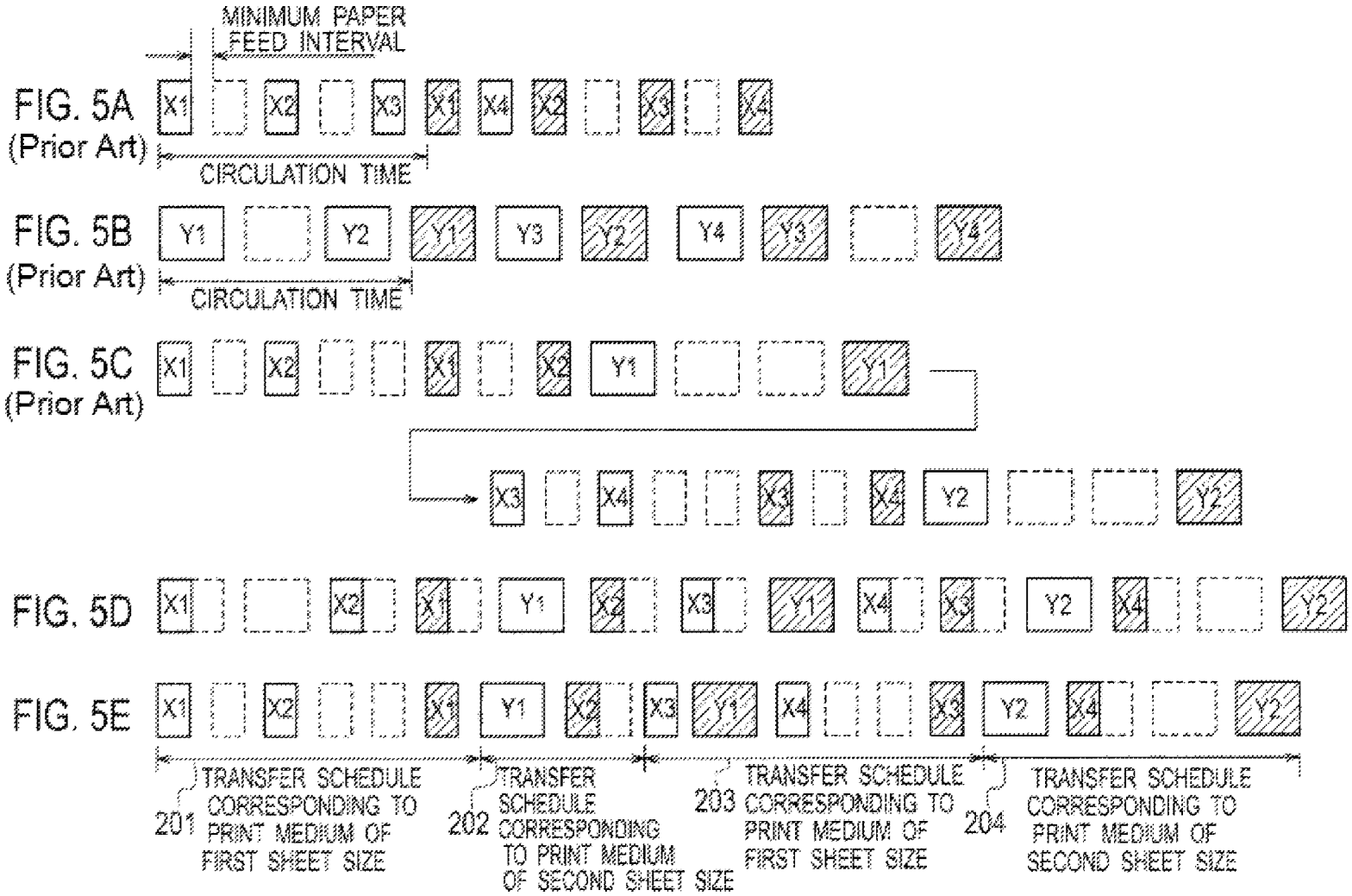
FIG. 5A (Prior Art)
FIG. 5B (Prior Art)
FIG. 5C (Prior Art)
FIG. 5A is a diagram showing a transfer schedule when printing only a first sheet by prior art.
FIG. 5B is a diagram showing a transfer schedule when printing only a second sheet by prior art, FIG.
FIG. 5D is a diagram showing a transfer schedule when performing first printing processing in the image forming apparatus according to an embodiment of the present invention.
FIG. 5E is a diagram showing a transfer schedule when performing second printing processing in the image forming apparatus according to an embodiment of the present invention.

FIG. 5 is a diagram schematically explaining the transfer schedule in the image forming apparatus 1. FIG. 5A is a diagram showing the transfer schedule when printing only the first sheet in prior art, FIG. 5B is a diagram showing the transfer schedule when printing only the second sheet in prior art, FIG. 5C is a diagram showing the transfer schedule when printing the first sheet and the second sheet in prior art, and FIG. 5D is a diagram showing the transfer schedule when performing the first printing processing in the image forming apparatus 1 according to an embodiment of the present invention. In FIG. 5, the first sheet is represented by X1, X2, . . . , and the second sheet by Y1, Y2, . . . . In either case, the print medium represented by a solid line frame represents surface printing and the print medium represented by a solid line frame with slashes represents back surface printing. The broken line represents a waiting time for transfer.

As shown in FIGS. 5A, 5B, the number of sheets held on the circulation/transfer route CR differs depending on the sheet size, and therefore, the transfer speed of the print medium when it is transferred on the circulating area 45 of the circulation/transfer route CR and the circulation time during which the print medium is circulated on the circulation/transfer route CR differ.

Because of the above, as shown in FIG. 5C, in prior art, when print media corresponding to two copies of a set of the two first sheets (A4 size) and the one second sheet (A3 size) are printed, after double-sided printing of the two first sheets and double-sided printing of the one second sheet are completed, double-sided printing of the next copy is performed, and therefore, the waiting time for transfer represented by the broken line is lengthened.

On the other hand, as shown in FIG. 5D, according to the image forming apparatus 1, the transfer schedule is set so that the print media of the two kinds of sheet sizes are transferred on the circulating area 45 of the circulation/transfer route CR at the transfer speed for the larger sheet (here, the second sheet) and fed from the internal paper feed unit 20 or the reversal unit 50 to the secondary paper feed unit 14 and then the printing unit 30, and therefore, the waiting time for transfer is reduced and due to this, it is possible to reduce the time required to complete printing with a simple configuration.

In the image forming apparatus 1, although when a double-sided printing request using print media of two kinds of sheet sizes is included in the print job, the print media of two kinds of sheet sizes are transferred on the circulating area 45 of the circulation/transfer route CR at the transfer speed of the print medium of the larger sheet size, this is not limited and it is also possible to apply when double-sided printing is performed on the print media of more kinds of sheet sizes. For example, when a double-sided printing request using print media of more kinds of sheet sizes is included in the print job, it may also be possible to transfer the print media of these kinds of sheet sizes at the transfer speed of the print medium of the largest sheet size on the circulating area 45 of the circulation/transfer route CR. The above transfer speed corresponding to the largest sheet size is a transfer speed at which a print medium of the largest sheet size is transferred on the circulation/transfer route CR in the normal print job processing.

<<Second Printing Processing>>

Details of the second printing processing in the image forming apparatus 1 are explained.

Figure 6A:
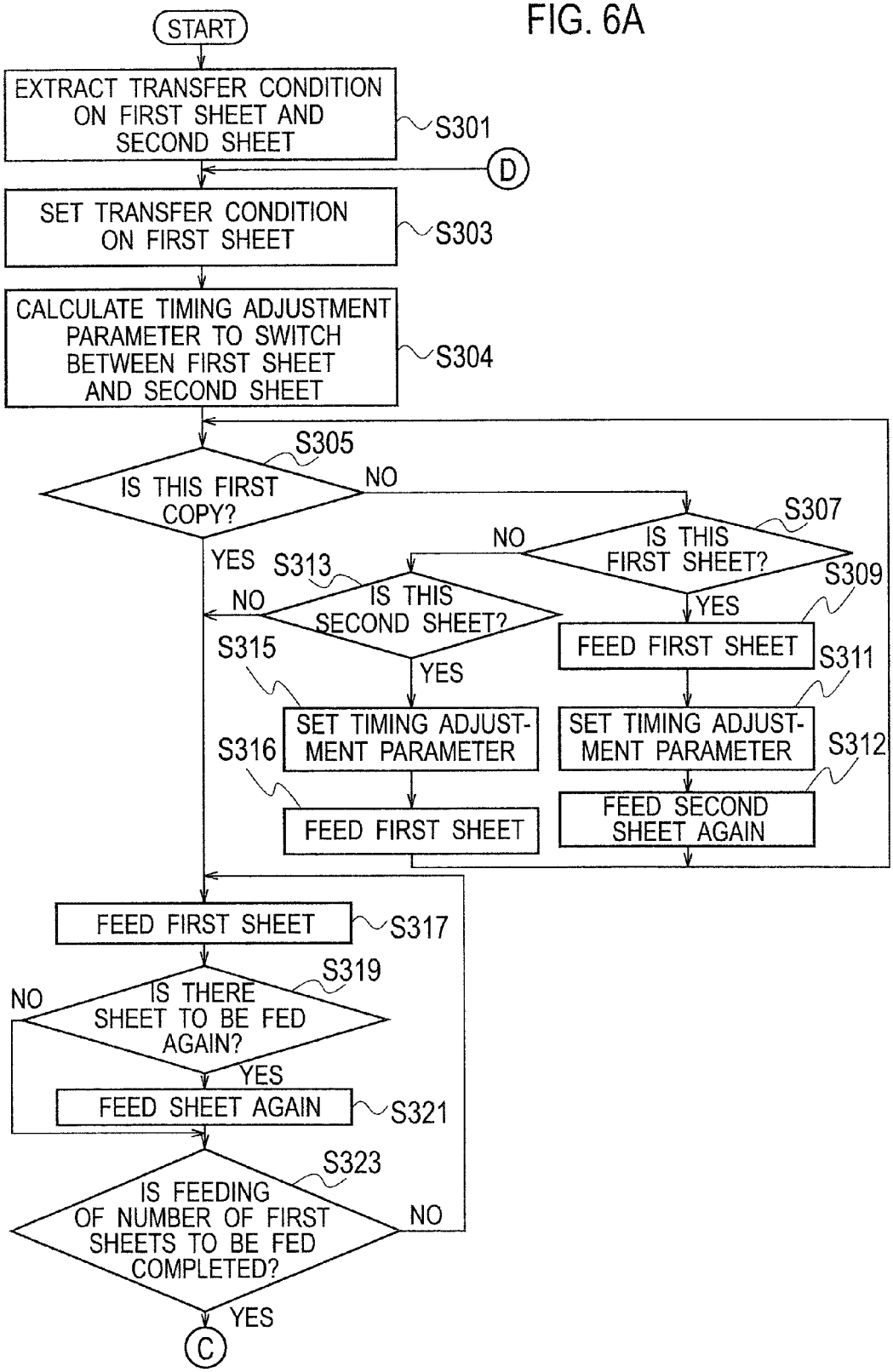
FIGS. 6A and 6B are a flowchart showing the second printing processing in the image forming apparatus in FIG. 1.
Figure 6B:
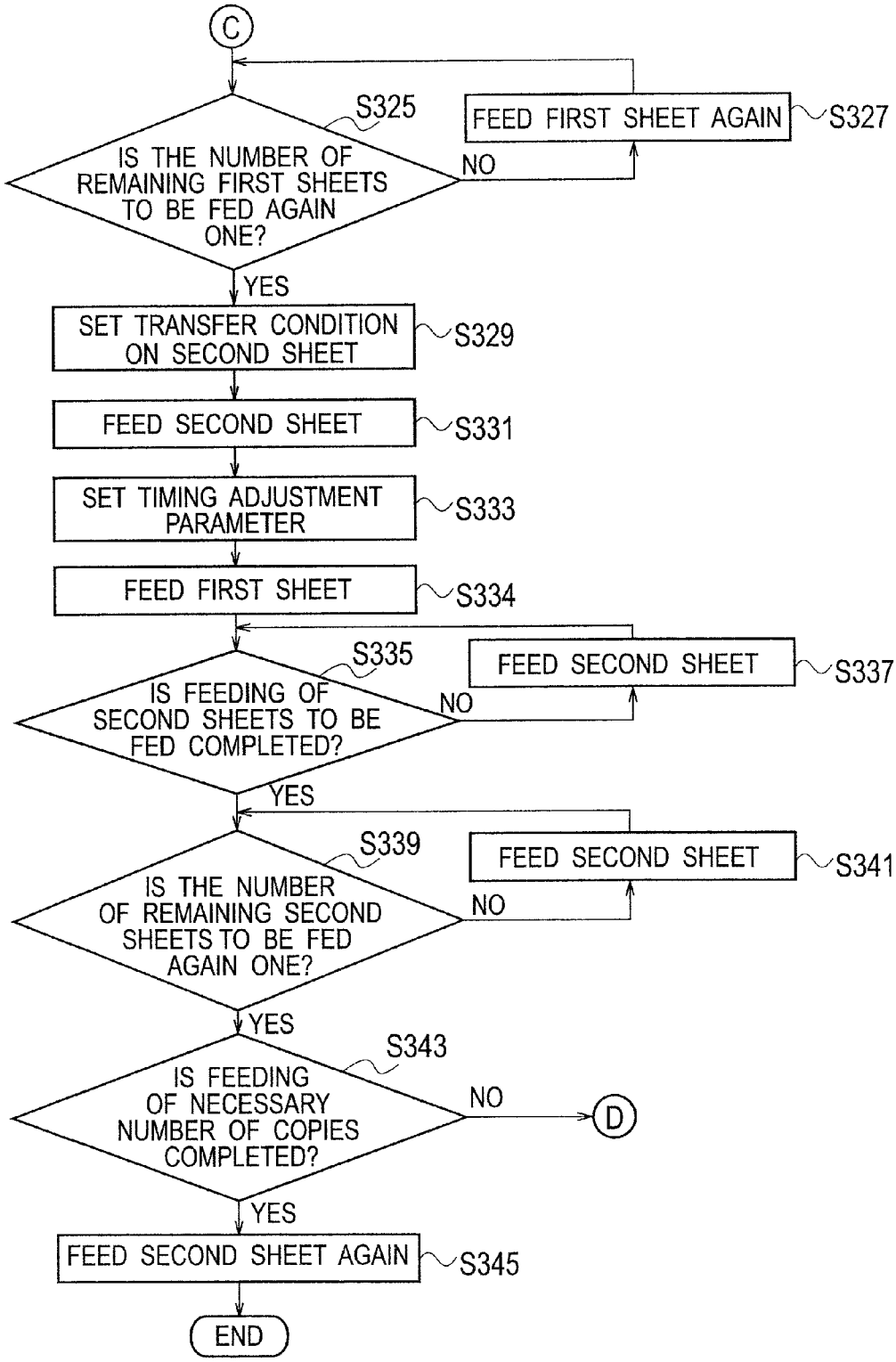

FIGS. 6A and 6B are a flowchart showing the second printing processing in the image forming apparatus 1. In the second printing processing, it is assumed that the print media of the first sheet size (the first sheet) are stacked on the paper feed table 21*a* and the print media of the second sheet size (the second sheet) are stacked on the paper feed table 21*b*.

As shown in FIGS. 6A and 6B, the transfer schedule setting unit 70*c* of the control unit 70 extracts the transfer condition on the first sheet and the second sheet, respectively (step S301). Specifically, the transfer schedule setting unit 70*c* extracts the minimum paper feed interval, the number of sheets with path, and the transfer speed on the circulating area 45 of the circulation/transfer route CR for the first sheet and the second sheet as the transfer condition from the received print job.

Next, the transfer schedule setting unit 70*c* sets the transfer condition on the first sheet (step S303). Specifically, the transfer schedule setting unit 70*c* sets the minimum paper feed interval $TM_1$, the number of sheets within path $C_1$, the transfer speed $V_1$ on the circulating area 45 of the circulation/transfer route CR for the fast sheet as the transfer condition. Due to this, the print medium is transferred by the transfer schedule for the first sheet as a result.

Next, the transfer schedule setting unit 70*c* calculates the transfer timing adjustment parameter of the first sheet and the second sheet based on the extracted transfer condition (step S304). Specifically, the transfer schedule setting unit 70*c* calculates a first adjustment time, an adjusted speed, and a second adjustment time described below. The first adjustment time is a time during which the print medium is put on standby on the reversal unit 50 when switching the sheet size of the first sheet and the second sheet from the small size sheet to the large size sheet then transferring the print medium to the printing unit 30. The adjusted speed is a speed higher than the normal transfer speed from the reversal unit 50, that is, an increased speed when switching the sheet size from the large size sheet to the small size sheet and then transferring the print medium to the printing unit 30. The second adjustment time is a time by which feeding is delayed so that the small size sheet is transferred from the internal paper feed unit 22*a* after the minimum paper feed time elapses after the large size sheet is transferred from the reversal unit 50 when switching the sheet size from the large size sheet to the small size sheet and then transferring the print medium to the printing unit 30.

Next, the transfer schedule setting unit 70*c* determines whether or not the print medium to be printed is the first copy (step S305).

When it is determined that the print medium to be printed is the first copy in step S305 (when YES), the equipment control unit 70*d* of the control unit 70 feeds the first sheet (step S317). Specifically, the equipment control unit 70*d* causes the primary paper feed unit 22*a* to transfer only the print medium in the uppermost position from the paper feed table 21 onto the paper feed/transfer route FR and at the same time, causes the secondary paper feed unit 14 to transfer the print medium transferred by the primary paper feed unit 22*a* to the printing unit 30.

Then, the transfer schedule setting unit 70*c* of the control unit 70 determines whether or not there is a sheet to be fed again (step S319). Specifically, the transfer schedule setting unit 70*c* determines whether or not there is a print medium on the reversal table 51 of the reversal unit 50.

When it is determined that there is a sheet to be fed again in step S319 (when YES), the equipment control unit 70*d* of the control unit 70 feeds the print medium on the reversal table 51 of the reversal unit 50 again to the printing unit 30 (step S321).

Next, the transfer schedule setting unit 70*c* of the control unit 70 moves processing to step S325 when determining that feeding of the number of the first sheets to be fed S1 is completed (step S323).

On the other hand, when it is determined that the print medium to be printed is not the first copy in step S305 (when NO), the transfer schedule setting unit 70*c* determines whether or not the print medium to be printed is the first sheet (step S307).

When it is determined that the print medium to be printed is the first sheet in step S307 (when YES), the equipment control unit 70*d* of the control unit 70 feeds the first sheet (step S309). Specifically, the equipment control unit 70*d* causes the primary paper feed unit 22*a* to transfer only the print medium in the uppermost position from the paper feed table 21*a* onto the paper feed/transfer route FR and at the same time, causes the secondary paper feed unit 14 to transfer the print medium transferred by the primary paper feed unit 22*a* to the printing unit 30.

Then, the transfer schedule setting unit 70*c* sets the timing adjustment parameter calculated in step S304 (step S311). Specifically, the transfer schedule setting unit 70*c* sets the first adjustment time when the print medium is switched from the small sheet size to the large sheet size, that is, when the first sheet is the small size and the second sheet is the large size. Alternatively, the transfer schedule setting unit 70*c* sets the adjusted speed when the print medium is switched from the large sheet size to the small sheet size, that is, when the first sheet is the large size and the second sheet is the small size.

Next, the equipment control unit 70*d* feeds the second sheet again (step S312). Specifically, the equipment control unit 70*d* feeds the print medium on the reversal table 51 of the reversal unit 50 again to the printing unit 30 by controlling the reversal unit 50 by the set first adjustment time or adjusted speed based on the transfer schedule for the first sheet (step S312).

FIG. 5E is a diagram showing a transfer schedule when the second printing processing is performed in the image forming apparatus 1. Here, the transfer schedule is shown when the first sheet is the small size (A4 size) and the second sheet is the large size (A3 size) and two of copies of a set of the two A4 size sheets and the one A3 size sheet are printed.

By transfer schedules 201, 203 shown in FIG. 5E, the first sheet and the second sheet are transferred by the transfer schedule for the first sheet and by transfer schedules 202, 204, the first sheet and the second sheet are transferred by the transfer schedule for the second sheet.

In the example shown in FIG. 5E, the timing at which the small sheet (the first sheet) is switched to the large sheet (the second sheet) in step S311 is, for example, the timing at which surface printing of X3 is switched to surface printing of Y1 and Y1 transferred to the reversal unit 50 after X3 is fed in step S309 is set to the adjusted speed, and therefore, by the reversal roller 52 rotating at high speed so that the set adjusted speed is reached, it is discharged from the reversal unit 50.

Next, returning to FIG. 6A, when it is determined that the print medium to be printed is not the first sheet in step S307 (when NO), the transfer schedule setting unit 70*c* determines whether or not the print medium to be printed is the second sheet (step S313).

When it is determined that the print medium to be printed is the second sheet in step S313 (when YES), the timing adjustment parameter calculated in step S304 is set (step S315). Specifically, the transfer schedule setting unit 70*c* sets the second adjustment time when the print medium is switched from the large size sheet to the small size sheet, that is, the first sheet is the large size and the second sheet is the small size.

Then, the equipment control unit 70*d* of the control unit 70 feeds the first sheet (step S316). Specifically, the equipment control unit 70*d* causes the paper feed table 21*a* to transfer only the print medium in the uppermost position onto the paper feed/transfer route FR and at the same time causes the secondary paper feed unit 14 to transfer the print medium transferred by the primary paper feed unit 22*a* to the printing unit 30 by controlling the primary paper feed unit 22*a* and the secondary paper feed unit 14 by the set second adjustment time based on the transfer schedule for the first sheet.

In the example shown in FIG. 5E, this is, for example, the timing at which back surface printing of Y1 is switched to surface printing of X4, and at this time, the second adjustment time is set, and therefore, Y1 is transferred to the printing unit 30 and feeding is delayed so that X4 is transferred after the minimum paper feed time elapses. Due to this, it is possible to appropriately feed sheets without overlapping of Y1 and X4.

As described above, when transferring the print medium to the secondary paper feed unit 14 and then to the printing unit 30 by switching the transfer schedule 202 for the large size print medium to the transfer schedule 203 for the small size print medium, the transfer schedule is set so that the large size print medium is transferred at the increased transfer speed at which the print medium is transferred from the reversal unit 50 when the print medium is switched from the small size to the large size and at the same time, the small size print medium transferred from the primary paper feed unit 22*a* is transferred after the minimum paper feed time elapses after the large size print medium is transferred from the reversal unit 50 when the print medium of the large size is switched to the print medium of the small size. Due to this, A3, B1, A4, A3 are transferred by the transfer schedule for the first sheet (the small print medium).

Returning to FIG. 6A, when it is determined that feeding of the number of the first sheets to be fed S1 is completed in step S323, the transfer schedule setting unit 70*c* determines whether or not the number of the remaining first sheets to be fed again is one based on the print job (step S325).

When it is determined that the number of the remaining first sheets to be fed again is not one in step S325 (when NO), the equipment control unit 70*d* feeds the first sheet again (step S327).

On the other hand, when it is determined that the number of the remaining first sheets to be fed again is one in step S325 (when YES), the transfer schedule setting unit 70*c* sets the transfer condition on the second sheet (step S329). Specifically, the transfer schedule setting unit 70*c* sets the minimum paper feed interval TM2, the number of sheets within path C2, and the transfer speed V2 on the circulating area 45 of the circulation/transfer route CR for the second sheet as the transfer condition. Due to this, the print medium is transferred by the transfer schedule for the second sheet as a result.

Then, the equipment control unit 70*d* feeds the second sheet (step S331).

Next, the transfer schedule setting unit 70*c* sets the timing adjustment parameter calculated in step S329 (step S333). Specifically, the transfer schedule setting unit 70*c* sets the first adjustment time when the print medium is switched from the small size sheet to the large size sheet, that is, the first sheet is the small size and the second sheet is the large size. Alternatively, the transfer schedule setting unit 70*c* sets the adjusted speed and the second adjustment time when the print medium is switched from the large size sheet to the small size sheet, that is, the first sheet is the large size and the second sheet is the small size.

Then, the equipment control unit 70*d* feeds the first sheet (step S334).

In the example shown in FIG. 5E, for example, the timing at which the print medium is switched from the large size sheet to the small size sheet in step S333 is, for example, the timing at which surface printing of Y1 is switched to back surface printing of X2 and in this case, the first adjustment time is set, and therefore, X2 transferred to the reversal unit 50 is fed to the printing unit 30 after being put on standby on the reversal unit 50 for the period of time corresponding to the first adjustment time.

As described above, when transferring the print medium to the secondary paper feed unit 14 and then to the printing unit 30 by switching the transfer schedule 201 for the small size sheet to the transfer schedule 202 corresponding to the large size sheet, the print medium is transferred at the transfer speed for the large size sheet by putting the print medium on standby on the reversal unit 50 when switching the print medium from the large size sheet to the small size sheet. Due to this, Y1 and X2 are transferred by the transfer schedule corresponding to the second sheet (large sheet medium).

Returning to FIG. 6B, when the first sheet is fed in step S334, the transfer schedule setting unit 70*c* of the control unit 70 determines whether or not feeding of the number of the second sheets to be fed S2 is completed (step S335).

When it is determined that feeding of the number of the second sheets to be fed S2 is not completed in step S335 (when NO), the equipment control unit 70*d* feeds the second sheet (step S337).

On the other hand, when it is determined that feeding of the number of the second sheets to be fed S2 is completed in step S335 (when YES), the transfer schedule setting unit 70*c* determines whether or not the number of the remaining second sheets to be fed again is one (step S339).

When it is determined that the number of the remaining second sheets to be fed again is not one in step S339 (when NO), the equipment control unit 70*d* feeds the second sheet again (step S337).

On the other hand, when it is determined that the number of the remaining second sheets to be fed again is one in step S339 (when YES), the transfer schedule setting unit 70*c* determines whether or not feeding of the necessary number of copies is completed (step S343). In the example shown in FIG. 5E, whether or not print media corresponding to two copies of a set of the two first sheets (A4 size) and the one second sheet (A3 size) are fed from the paper feed table 21*a* or the paper feed table 21*b* is determined.

When it is determined that feeding of the necessary number of copies is completed in step S343 (when YES), the equipment control unit 70*d* feeds the second sheet again (step S345).

As described above, according to the image forming apparatus 1 according to an embodiment of the present invention, when a double-sided printing request using print media of two kinds of sheet sizes is included in the print job, the transfer schedule of the print media of two kinds of sheet sizes is set so that the waiting time for transfer is reduced, and therefore, it is possible to reduce the time required to complete printing with a simple configuration.

In the image forming apparatus 1 according to an embodiment of the present invention, the transfer schedule is set so that before the print medium of a certain sheet size that is reversed by the reversal unit 50 and precedes is transferred to the printing unit 30, the print medium of another sheet size that follows is transferred from the side paper feed unit 10 or the internal paper feed unit 20 to the printing unit 30 for each set of two kinds of sheet sizes, however, the image forming apparatus 1 is not limited to this and can also be applied to a set of more kinds of sheet sizes.

For example, it may also be possible to set the transfer schedule so that before the last print medium of a certain first sheet size that is reversed by the reversal unit 50 is transferred to the secondary paper feed unit 14 and then to the printing unit 30, the print medium of a second sheet size, which follows the print media of the first sheet size, is transferred from the side paper feed unit 10 or the internal paper feed unit 14 to the secondary paper feed unit 14 and then to the printing unit 30 by comparing the sheets sizes before and after switching for each set of three or more kinds of sheet sizes, and to repeat this so many times as the number of distinct sheet sizes.

The image forming apparatus 1 according to an embodiment of the present invention is explained using the example in which sheets are fed from the internal paper feed unit 20, however, this is not limited and sheets may be fed from the side paper feed unit 10.

The present application claims the benefit of priority under 35 U.S.C. §119 to Japanese Patent Application No. 2010-170373, filed on Jul. 29, 2010, the entire content of which is incorporated herein by reference.

What is claimed is:

1. An image forming apparatus, comprising:

a plurality of paper feed units configured to draw and feed, one by one, print media stacked on a paper feed table with sheet sizes different from one another;

a printing unit configured to print a print medium fed by the paper feed units, based on a received print job including one of a first print job or a second print job, the first print job not including a double-sided printing request of a set of print media of a plurality of sheet sizes, the second print job including a double-sided printing request of a set of print media of a plurality of sheet sizes;

a resist unit configured to transfer print medium fed from the plurality of paper feed units to the printing unit at a predetermined timing;

a circulating path configured to transfer print medium printed by the printing unit at a transfer speed, the transfer speed in the first print job being determined for each sheet size;

a reversal unit configured to reverse print medium transferred on the circulating path and then transfer the reversed print medium to the resist unit;

a transfer schedule setting unit configured to set, when the received print job is the second print job, a transfer schedule for the set of the print media of the plurality of sheet sizes; and a control unit configured to start feeding or transfer from any one of the plurality of paper feed units or the reversal unit to the resist unit based on the set transfer schedule, wherein the transfer schedule setting unit is configured to set the transfer schedule so that before a last print medium of a first sheet size reversed by the reversal unit is transferred to the resist unit, the print medium of a second sheet size different from the first sheet size that follows the print medium of the first sheet size is fed from any one of the plurality of paper feed units to the resist unit, and wherein the transfer schedule setting unit is configured to set the transfer schedule so that:

when the transfer schedule is switched from the print medium of a small sheet size to the print medium of a large sheet size larger than the small sheet size, the transfer schedule of the print medium on the circulating path is the transfer schedule for the print medium of the large sheet size, and further a start of transfer of the print medium of the small sheet size from the reversal unit to the resist unit is delayed by a predetermined time; and when the transfer schedule is switched from the print medium of the large sheet size to the print medium of the small sheet size, the transfer schedule of the print medium on the circulating path is the transfer schedule for the small sheet size, the transfer speed of the print medium of the large sheet size from the reversal unit to the resist unit is a transfer speed increased higher than a transfer speed in the transfer schedule of the small sheet size, and the print medium of the small sheet size is fed from any one of the plurality of paper feed units after a minimum paper feed interval elapses after the start of transfer of the print medium of the large sheet size from the reversal unit to the resist unit.

2. An image forming apparatus, comprising:

a plurality of paper feed units configured to draw and feed, one by one, print media stacked on a paper feed table with sheet sizes different from one another;

a printing unit configured to print a print medium fed by the paper feed units, based on a received print job including one of a first print job or a second print job, the first print job not including a double-sided printing request of a set of print media of a plurality of sheet sizes, the second print job including a double-sided printing request of a set of print media of a plurality of sheet sizes;

a resist unit configured to transfer print medium fed from the plurality of paper feed units to the printing unit at a predetermined timing;

a circulating path configured to transfer print medium printed by the printing unit at a transfer speed, the transfer speed in the first print job being determined for each sheet size;

a reversal unit configured to reverse print medium transferred on the circulating path and then transfer the reversed print medium to the resist unit;

a transfer schedule setting unit configured to set, when the received print job is the second print job, a transfer schedule for the set of the print media of the plurality of sheet sizes; and a control unit configured to start feeding or transfer from any one of the plurality of paper feed units or the reversal unit to the resist unit based on the set transfer schedule, wherein the transfer schedule is a first transfer schedule or a second transfer schedule, the first transfer schedule transfers the print media of the plurality of sheet sizes to the resist unit by transferring the print media on the circulating path at a transfer speed at which a print medium of the largest sheet size of the plurality of sheet sizes is transferred on the circulating path in the first print job, or the second transfer schedule transfers, before transferring a last print medium of a first sheet size reversed by the reversal unit to the resist unit, the print medium of a second sheet size different from the first sheet size that follows the print medium of the first sheet size from any one of the plurality of paper feed units to the resist unit for each set of the plurality of sheet sizes, and the transfer schedule setting unit is further configured to calculate a productivity of the first transfer schedule and a productivity of the second transfer schedule based on the second print job as received, and set the transfer schedule based on which transfer schedule requires shorter time to complete printing.

3. The image forming apparatus according to claim 2, wherein the transfer schedule setting unit is configured to set the transfer schedule so that feeding or transfer from any one of the plurality of paper feed units or the reversal unit to the resist unit is performed by transferring the print media of the set of print media of the plurality of sheet sizes, on the circulating path at a transfer speed at which a print medium of the largest sheet size of the plurality of sheet sizes is transferred on the circulating path in the first print job.

4. The image forming apparatus according to claim 2, wherein the transfer schedule setting unit is configured to set the transfer schedule so that before a last print medium of a first sheet size reversed by the reversal unit is transferred to the resist unit, the print medium of a second sheet size different from the first sheet size that follows the print medium of the first sheet size is fed from any one of the plurality of paper feed units to the resist unit.

5. An image forming method in an image forming apparatus including:

a plurality of paper feed units configured to draw and feed, one by one, print media stacked on a paper feed table with sheet sizes different from one another;

a printing unit configured to print a print medium fed by the paper feed unit based on a received print job including one of a first print job or a second print job, the first print job not including a double-sided printing request of a set of print media of a plurality of sheet sizes, the second print job including a double-sided printing request of a set of print media of a plurality of sheet sizes;

a resist unit configured to transfer a print medium fed from the plurality of paper feed units to the printing unit at a predetermined timing;

a circulating path configured to transfer a print medium printed by the printing unit at a transfer speed, the transfer speed in the first print job being determined for each sheet size;

a reversal unit configured to transfer a print medium transferred on the circulating path and then transfer the reversed print medium to the resist unit, the method comprising:

setting a transfer schedule, when the received print job is the second print job, for the set of print media of the plurality of sheet sizes according to the sheet size of the print media, using a transfer schedule setting unit; and controlling a start of feeding or transfer from any one of the plurality of paper feed units or the reversal unit to the resist unit based on the set transfer schedule, using a control unit, wherein in setting the transfer schedule, the transfer schedule is set so that before a last print medium of a first sheet size reversed by the reversal unit is transferred to the resist unit, the print medium of a second sheet size different from the first sheet size that follows the print medium of the first sheet size is fed from any one of the plurality of paper feed units to the resist unit, and wherein in setting the transfer schedule, the transfer schedule is set so that:

when the transfer schedule is switched from the print medium of a small sheet size to the print medium of a large sheet size larger than the small sheet size, the transfer schedule of the print medium on the circulating path is the transfer schedule for the print medium of the large sheet size, and further a start of transfer of the print medium of the small sheet size from the reversal unit to the resist unit is delayed by a predetermined time; and when the transfer schedule is switched from the print medium of the large sheet size to the print medium of the small sheet size, the transfer schedule of the print medium on the circulating path is the transfer schedule for the small sheet size, the transfer speed of the print medium of the large sheet size from the reversal unit to the resist unit is a transfer speed increased higher than a transfer speed in the transfer schedule of the small sheet size, and the print medium of the small sheet size is fed from any one of the plurality of paper feed units after a minimum paper feed interval elapses after the start of transfer of the print medium of the large sheet size from the reversal unit to the resist unit.

6. An image forming method in an image forming apparatus including:

a plurality of paper feed units configured to draw and feed, one by one, print media stacked on a paper feed table with sheet sizes different from one another;

a printing unit configured to print a print medium fed by the paper feed unit based on a received print job including one of a first print job or a second print job, the first print job not including a double-sided printing request of a set of print media of a plurality of sheet sizes, the second print job including a double-sided printing request of a set of print media of a plurality of sheet sizes;

a resist unit configured to transfer a print medium fed from the plurality of paper feed units to the printing unit at a predetermined timing;

a circulating path configured to transfer a print medium printed by the printing unit at a transfer speed, the transfer speed in the first print job being determined for each sheet size;

a reversal unit configured to transfer a print medium transferred on the circulating path and then transfer the reversed print medium to the resist unit, the method comprising:

setting a transfer schedule, when the received print job is the second print job, for the set of print media of the plurality of sheet sizes according to the sheet size of the print media, using a transfer schedule setting unit; and controlling a start of feeding or transfer from any one of the plurality of paper feed units or the reversal unit to the resist unit based on the set transfer schedule, using a control unit, wherein the transfer schedule is a first transfer schedule or a second transfer schedule the first transfer schedule transfers the print media of the plurality of sheet sizes to the resist unit by transferring the print media on the circulating path at a transfer speed at which a print medium of the largest sheet size of the plurality of sheet sizes is transferred on the circulating in the first print job, or the second transfer schedule transfers, before transferring a last print medium of a first sheet size reversed by the reversal unit to the resist unit, the print medium of a second sheet size different from the first sheet size that follows the print medium of the first sheet size from any one of the plurality of paper feed units to the resist unit for each set of the plurality of sheet sizes, and in setting the transfer schedule, a productivity of the first transfer schedule and a productivity of the second transfer schedule are calculated based on the second print job as received, and the transfer schedule is set based on which transfer schedule requires shorter time to complete printing.

7. The image forming method according to claim 6, wherein in setting the transfer schedule, the transfer schedule is set so that feeding or transfer from any one of the plurality of paper feed units or the reversal unit to the resist unit is performed by transferring the print media of the set of print media of the plurality of sheet sizes, on the circulating path at a transfer speed at which a print medium of the largest sheet size of the plurality of sheet sizes is transferred on the circulating path in the first print job.

8. The image forming method according to claim 6, wherein in setting the transfer schedule, the transfer schedule is set so that before a last print medium of a first sheet size reversed by the reversal unit is transferred to the resist unit, the print medium of a second sheet size different from the first sheet size that follows the print medium of the first sheet size is fed from any one of the plurality of paper feed units to the resist unit.

* * * * *